United States Patent [19]

Weber

[11] 4,379,444

[45] Apr. 12, 1983

[54] START-TO-RUN CIRCUIT FOR AN ELECTRONIC IGNITION SYSTEM

[75] Inventor: Howard Weber, Scottsdale, Ariz.

[73] Assignee: Motorola, Inc., Schaumburg, Ill.

[21] Appl. No.: 253,423

[22] Filed: Apr. 13, 1981

[51] Int. Cl.[3] ..... F02P 9/00

[52] U.S. Cl. ..... 123/609; 123/424; 123/644

[58] Field of Search ..... 123/609, 610, 611, 625, 123/644, 179 BG, 424

[56] References Cited

U.S. PATENT DOCUMENTS

| | | | |
|---|---|---|---|
| 3,937,193 | 2/1976 | Kim | 123/611 |
| 4,095,576 | 6/1978 | Hattori et al. | 123/609 |
| 4,131,098 | 12/1978 | Daniels et al. | 123/424 |
| 4,133,325 | 1/1979 | West | 123/644 |

*Primary Examiner*—Tony M. Argenbright
*Assistant Examiner*—Andrew M. Dolinar
*Attorney, Agent, or Firm*—Michael D. Bingham

[57] ABSTRACT

A circuit to be utilized in combination with an ignition system which is responsive to a start signal supplied thereto for maintaining the ignition system in a start mode of operation while starting of the internal combustion engine is controlled by the ignition system. The circuit is responsive to termination of the start signal to provide transitioning of the ignition system to a run mode of operation only during the current ramping period when the ignition coil of the ignition system is being charged prior to the end of a firing cycle when the coil is discharged to provide spark to operate the engine. Start retard and transitioning of the system from start to run modes is provided utilizing a single capacitor.

7 Claims, 3 Drawing Figures

START-TO-RUN CIRCUIT FOR AN ELECTRONIC IGNITION SYSTEM

CROSS REFERENCE TO A RELATED APPLICATION

The subject matter of the subject application is related to U.S. Pat. application Ser. No. 06/253,770, titled "IGNITION SYSTEM HAVING VARIABLE PERCENTAGE CURRENT LIMITING", filed concurrently herewith and which is assigned to Motorola Inc. designated by assignee's docket number SC-81933.

BACKGROUND OF THE INVENTION

1. Field of the Invention

This invention relates to high energy ignition systems and particularly to a start-to-run transition circuit for providing transition from a start mode of operation to a run mode of operation while preventing a misfire spark or a misplaced spark from occurring.

2. Description of the Prior Art

Almost all electronic ignition systems utilized in today's automobile comprise a circuit for transitioning between a start and run mode of operation. Most contempory transitioning circuits require a separate discrete capacitor to be utilized in addition to other capacitors used in the ignition system. Each separate discrete capacitor required for operation of the ignition system is an added expense thereto. Considering that each automobile manufacture by the automobile industry requires a separate ignition system thereto, it is desirous for suppliers of ignition systems to the automobile industry to eliminate unneeded components and to initiate as many cost saving features to the ignition system as possible.

Thus, a need exists for a start-to-run transition circuit wherein the need for a separate capacitor for dwell requirements in both start and run modes is eliminated.

SUMMARY OF THE INVENTION

Accordingly, it is an object of the present invention to provide an improved start-to-run transition circuit that allows transition from a start mode to a run mode of operation without causing false or missing output spark pulses.

Another object of the present invention is to provide a start-to-run transition circuit comprising both linear and logic circuits which utilizes a single capacitor to provide dwell requirements under both the start and run mode of operation.

Still another object is to provide a start-to-run circuit using a single capacitor for providing start retard and dwell requirements in an ignition system while permitting transition of the ignition system to a run mode during a predetermined time period of a firing cycle period.

In accordance with the above and other objects, there is provided a start-to-run circuit for combination with an ignition system having an adaptive dwell capacitor for varying the excess dwell time of the ignition system with variations in engine rpm wherein the circuit comprises a start dwell circuit coupled to the adaptive dwell capacitor of the ignition system for charging and discharging the same between first and second potential levels when the ignition system is in a start mode of operation to provide start retard, the start dwell circuit providing a logic output signal therefrom when the potential across the adaptive dwell capacitor is at one of the first and second potential levels; logic circuit means responsive to a start command signal for placing the ignition system in a start mode of operation; and logic gate means responsive to the logic circuit and the start dwell logic output signal during the start mode of operation for producing dwell current to the ignition coil to produce spark for starting the engine, the logic circuit being responsive to the start command signal being terminated in conjunction with dwell current ramping through the ignition coil for providing an output signal to transition the ignition system to a run mode of operation wherein the logic gate circuitry becomes responsive to an adaptive dwell input signal provided by the ignition system in the run mode of operation.

DETAILED DESCRIPTION OF THE PREFERRED EMBODIMENT

Figure 1:
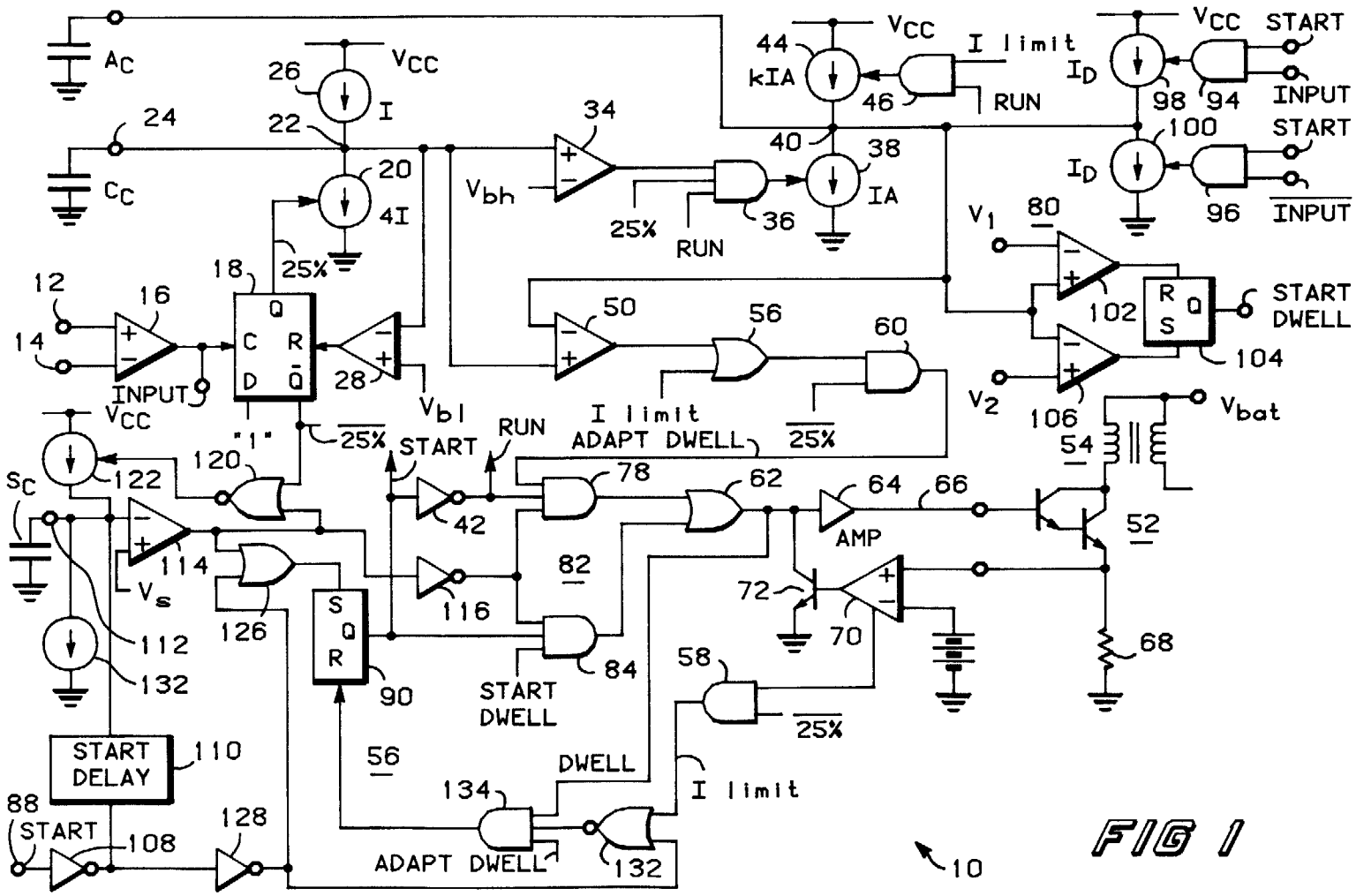
FIG. 1 is a partial block and schematic diagram illustrating a solid state ignition system including a start-to-run transition circuit of the present invention.
Figure 2:
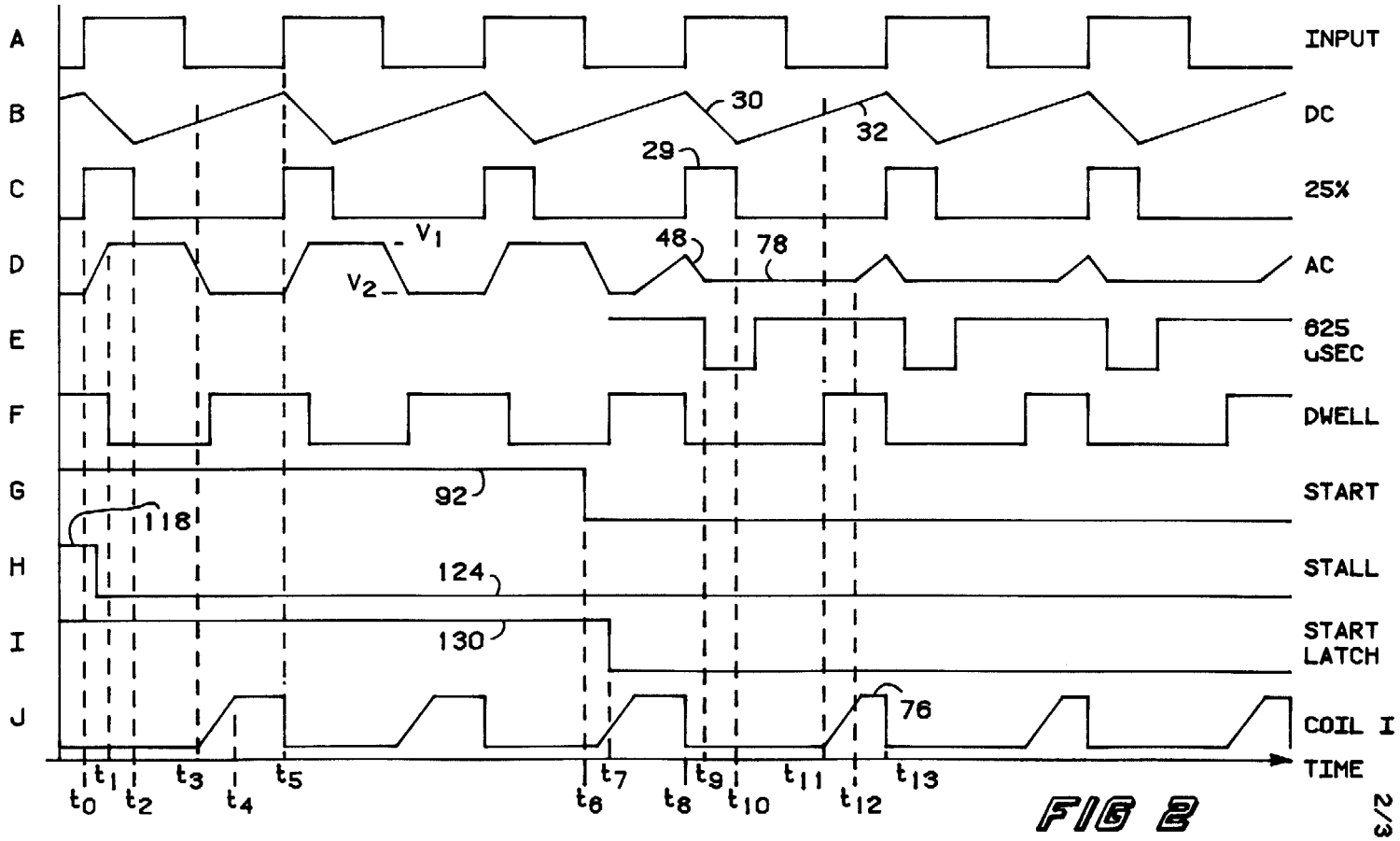
FIG. 2 illustrates waveforms useful only in understanding the operation of the embodiment shown in FIG. 1.

Turning to FIGS. 1 and 2 there is shown and described ignition system 10 which is responsive to ignition timing signals generated in time relationship to an internal combustion engine for controlling the charging and discharging of the ignition coil of the engine system. Ignition timing signals having generally a sinusoidal shape with positive and negative portions are produced in time relationship with the engine in a well known manner. These timing signals are differentially applied to input terminals 12 and 14 of differential comparator 16 which has hysteresis associated therewith. The output signal from comparator 16, which is applied as an input signal to the C input terminal of D-type flip-flop 18, is of general square wave shape as shown in FIG. 2A. The Q output terminal of flip-flop 18 is applied to a control input of current source 20 to render the current source conductive in response to the Q logic signal, designated the 25% signal. Current source 20 is coupled between node 22 and a source of ground reference potential to a capacitor $C_C$ at node 24. A second current source 26 is shown coupled between a source of operating potential $V_{CC}$ and node 22; node 22 is returned via a lead line to the inverting input of differential comparator 28. The non-inverting input of differential comparator 28 is coupled to a reference potential $V_{bl}$ with the output of the comparator being returned to a reset input terminal of D-type flip-flop 18. Assuming that the system is in a run mode of operation, in response to a particular timing signal crossing the zero axis in a positive direction (time $t_8$), a logic one signal is supplied at the Q output of flip-flop 18 to render current source 20 conductive, portion 29 of waveform 2C. Current source 20 provides a current of magnitude 4I which therefore sinks all of the current I provided from current source 26. Hence, capacitor $C_C$ is discharged at a rate proportional to the current magnitude of 3I as shown by portion 30 of waveform 2B. Capacitor $C_C$ is discharged by current source 20 until such time that the potential thereacross decreases below the reference potential $V_{bl}$ which produces an output signal from differential comparator 28 to reset flip-flop 18. Thereafter, the Q output signal from flip-flop 18 goes to zero at time $t_{10}$ (waveform 2C). As the Q output of flip-flop 18 goes to zero, current source 22 is rendered non-conductive to allow capacitor $C_C$ to charge at a rate proportional to the current I from current source 26 (portion 32 of waveform 2B). Hence, a monopulse output signal occurs at the Q output of flip-flop 18 during the initial time period of each firing cycle which lasts for an approximately 25 percent of the total firing cycle, $t_8$–$t_{13}$. During the remainder of the firing cycle, the $\overline{Q}$ output terminal of flip-flop 18 goes to a logic one and is noted by the $\overline{25\%}$ output signal shown.

A second or threshold signal producing circuit portion is shown comprising differential comparator 34 the non-inverting input of which is coupled to node 22 to capacitor $C_C$ and the inverting input being coupled to a second bias potential $V_{bh}$. The output of differential comparator 34 is coupled to a first input of AND gate 36. The output of AND gate 36 controls the conduction of current source 38 which is coupled between node 40 and ground reference potential. A second input of NAND gate 36 is coupled to the Q output of flip-flop 18 with a third input being coupled to the output of inverter 42. The input of inverter 42 is coupled to the output of a novel start-to-run transition circuit which as will be more fully explained, causes the output of inverter 42 to be at a logic one state whenever the engine and the ignition system are in a run mode. Controlled current source 44 is coupled between a source of operating potential and node 40 and is rendered conductive or non-conductive by the logic output signal from AND gate 46. As will be later explained, at the initiation of each firing cycle period, the potential across capacitor $C_C$ is at an upper peak magnitude and an output signal, waveform 2E is produced at the output of differential comparator 34 to enable AND gate 36 to produce a logic one signal until such time that the capacitor is discharged to the reference potential $V_{bh}$. Thereafter the output from comparator 34 goes low to disable AND gate 36 to cause the output therefrom to go to a logic zero state. Thus, during the time interval $t_8$–$t_9$ all of the inputs to NAND gate 36 are at a logic one state such that current source 38 is rendered conductive to discharge capacitor $A_C$, which is coupled to node 40, at a rate proportional to current $I_A$; portion 48 of waveform 2D. Capacitor $A_C$ will be discharged until time $t_9$, when the output of differential comparator 34 is caused to go to zero. The adaptive dwell threshold signal, waveform 2D, is then held at a substantially constant magnitude from time $t_9$–$t_{10}$ for a period of approximately 625 microseconds and thereafter until near the end of the firing cycle after which capacitor $A_C$ is charged at a constant ramp rate proportional to the current supplied by current source 44 as will be later explained. Hence, in response to initiation of each firing cycle, the adaptive dwell capacitor is discharged for a predetermined percentage minus a constant time period.

A third circuit portion comprising comparator 50 produces first and second switching signals for first rendering switching amplifier 52 conductive and then non-conductive to charge and then discharge ignition coil 54 to produce firing spark to the engine. The non-inverting input of differential comparator 50 is coupled to capacitor $C_C$ with the inverting input thereof being coupled to capacitor $A_C$. The output of comparator 50 is coupled to a first input of OR gate 56. A second input of OR gate 56 is coupled to an output of AND gate 58 to receive a logic input signal designated I limit. The output of OR gate 56 is coupled to a first input of AND gate 60. A second input of AND gate 60 is coupled to the $\overline{Q}$ or $\overline{25\%}$ logic signal from flip-flop 18. The output of AND gate 60 is coupled via AND gate 78 and OR gate 62 to drive the input of amplifier 64. Amplifier 64 provides drive current to switching amplifier 52 via lead 66.

In operation, with the engine in a run mode, during the first 25% of the firing cycle period, the $\overline{Q}$ output of flip-flop 18 is in a low state such that the output of AND gate 60 is at a logic zero state. Thus, amplifier 64 is maintained in a non-conductive state and switching amplifier 52 cannot be rendered conductive during the first 25% interval of the firing cycle, i.e., during time interval $t_8$–$t_{10}$. In fact, amplifier 64 is maintained non-conductive until such time that the potential across capacitor $C_C$ is charged to a magnitude greater than the magnitude of the threshold signal that appears across capacitor $A_C$ at which time an output signal from comparator 50 and OR gate 56 produces a logic one input signal to AND gate 60. If the engine is operating in the last 75% of the firing cycle period, both inputs to AND gate 60 will be at a logic one level such that a logic one is produced at the output thereof. Hence, all inputs to AND gate 78 are high to cause OR gate 62 to render amplifier 64 conductive. Therefore, at time $t_{11}$ switching amplifier 52 is rendered conductive to cause dwell current to begin flowing through coil 54 as shown by waveform 2J, during $t_{11}$–$t_{12}$. Current thus flows through resistor 68 which increases at the rate that coil 54 is charged until time $t_{12}$ when the magnitude of voltage thereacross exceeds the reference potential $V_{ref}$ supplied at the inverting input of comparator 70. Between time $t_{12}$–$t_{13}$, the current through switching amplifier 52 is linearly limited by the feedback signal from comparator 70 rendering transistor 72 conductive to reduce the drive through amplifier 64 (portion 76 of waveform 2J). Simultaneously with current limiting, a logic one output is produced from comparator 70 and supplied to an input of AND gate 58 which, in conjunction with the engine operating in the last 75% of the firing cycle, produces the logic signal, I limit, at the output thereof. Finally, a firing cycle is completed by the next successive ignition timing signal crossing the zero axis in a positive direction which causes the output of AND gate 60 to go to a logic zero which renders the switching amplifier non-conductive causing discharge of the ignition coil.

With the engine operating in a steady-state condition, i.e., neither being accelerated or decelerated, adaptive dwell capacitor $A_C$ is first discharged at a rate proportional to the current through current source 38 during the first twenty-five percent of the firing cycle period minus the 625 microseconds time period of the particular firing cycle, time $t_9$–$t_{10}$. Thereafter, with both current source 38 and 44 being held in a non-conductive state the magnitude of the potential across the capacitor is maintained substantially constant between time intervals $t_{10}$–$t_{12}$. At time $t_{12}$, in response to the logic signal $I_{limit}$, current source 44 is rendered conductive to charge capacitor $A_C$ at a rate K times the rate that was discharged. Hence, as the excess dwell time (the current limit time) increases or decreases, capacitor $A_C$ is either charged to a higher or lesser level which in turn either increases or decreases the potential level at which the capacitor is maintained (portion 78 of waveform 2D). Therefore, as the magnitude of the threshold signal is varied due to the foregoing, the time during the firing cycle, $t_{11}$, at which the magnitude of the potential across capacitor $C_C$ becomes equal to the magnitude of the threshold signal is also varied which in turn varies the time during the firing cycle that the switching amplifier is rendered conductive whereby the percentage of the time that the current through coil 54 is limited is varied.

As will be hereinafter explained, ignition system 10 includes a novel start-to-run circuit of the preferred embodiment that utilizes the adaptive dwell capacitor AC to provide start retard for allowing improved starting of the engine and further to allow the engine to transition from a start mode to the aforedescribed run mode while preventing misfire spark or misplaced fire spark which could otherwise damage the engine as is understood. The start-to-run circuit comprises start dwell circuit 80, logic gate circuit 82 including AND gate 78 and AND gate 84 and logic circuitry 86 which has an input coupled to start input terminal 88. In response to a start command signal being supplied to start terminal 88, a start latch logic signal is produced at the Q output of flip-flop or start latch 90 which places ignition system 10 in a start mode of operation. With the Q output of flip flop 90 being in a high state (portion 92 of waveform 2G) AND gate 78 will be inhibited as the input thereto from the output of inverter 42 is at a zero logic state. Additionally, start dwell circuit 80 is enabled in response to the start latch signal being supplied to inputs of AND gates 94 and 96 which in conjunction with the input signal and its complementary being supplied respectively to these gates causes a symmetrical charging and discharging of the adaptive dwell capacitor AC as current source 98 and current source 100 are alternately rendered conductive, waveform 2D. As is seen, the alternate charging and discharging of the adaptive dwell capacitor by start dwell circuit 80 produces a delay (start retard) from initiation of each firing cycle at $t_0$ to time $t_1$ during starting of the engine. Therefore, in response to the input signal going positive, the adaptive dwell capacitor is charged to a potential level substantially equal to the reference potential V1 which causes comparator 102 to provide a reset signal to the input of RS flip-flop 104 such that the Q output, which is designated as the start dwell signal, is forced to go to a low logic level state. In response to current source 100 discharging the adaptive dwell capacitor to the voltage potential level V2, comparator 106 produces a set signal to flip-flop 104 to cause the Q output thereof to go to a high level state. Hence, a logic one output state is produced at the output of start dwell circuit that is applied to the start dwell input of gate 84 during the time interval that the adaptive dwell capacitor is at the lower potential level, during time interval $t_4$–$t_5$.

As previously stated, in response to a start command signal supplied to input terminal 88, for instance when the ignition key is turned, a start latch signal is supplied at the Q output of flip-flop or latch 90 to place the ignition system in a start mode of operation as will now be explained. The start command signal at terminal 88 provides a logic one level state to inverter 108 which activates start delay circuit 110 to initially discharge stall capacitor SC which is connected thereto at terminal 112. Terminal 112 being connected to the inverting input of comparator 114 causes a high output signal to be produced at the output therefrom when the stall capacitor potential is reduced below the reference potential VS. This output signal from comparator 114 is coupled to the input of inverter 116 causing a zero logic level output state therefrom. Thus, logic gate circuit 82 is inhibited by the start delay circuit as long as the potential across the stall capacitor is below the potential level VS. Hence, logic gate circuit 82 is inhibited from providing an output signal to render amplifier 64 conductive to initiate dwell current until such time that the stall capacitor is charged to a potential level greater than $V_S$. This delay period is shown by portion 118 of the stall output signal, waveform 2H. Thus, from the initiation of the start command signal at $t_0$, a delay period occurs during which logic gate circuit 82 is maintained in an inhibited state. As soon as the stall capacitor is discharged below the potential $V_S$, both inputs to NOR gate 120 from comparator 120 and flip-flop 18 will be at a logic zero level state which renders current source 122 conductive to immediately start charging of the stall capacitor. When the stall capacitor has been charged to a potential greater than the reference potential $V_S$ the inhibiting signal from comparator 114 is terminated whereby a logic one level state is applied to the inputs of AND gates 78 and 84 as shown by waveform portion 124 of waveform 2H. At initiation of the start command signal a logic one level state is supplied to the input to OR gate 126 via inverter 128 which is coupled between the input of NOR gate 126 and the output of inverter 108. Thus, start latch 90 is put in a set state and the Q output goes to a logic one output which inhibits AND gate 78 via inverter 42 such that the ignition system 10 is inhibited from being transitioned to a run mode of operation. However, AND gate 84 enabled by the high inputs from start latch 90 and start dwell circuit 80 to clock a logic one through NOR gate 62 to initiate dwell current through the coil at time $t_3$ during the start mode of operation of ignition system 10.

As discussed previously, at $t_4$ the magnitude of the coil current is great enough to initiate a limit control signal from AND gate 58 to limit the current through the ignition coil. At $t_5$, in response to the initiation of the next successive timing signal from the engine, the coil is discharged and the aforedescribed firing cycle period repeats. However, as long as the start command signal is supplied to input terminal 88, start latch 90 is maintained in a set state and no transition can occur. In order to transition to a run mode of operation, several conditions must be met which ensure that transition occurs during the time interval that the current through ignition coil 54 is ramping and not during the current limiting interval.

Several conditions must simultaneously occur before the ignition system is enabled to transition from a start mode to a run mode of operation; these conditions occur at $t_7$. As shown, the start command signal must be low (waveform 2G) which allows start latch 90 to be reset whereby the Q output goes low to enable AND gate 78 and to disable AND gate 84. Dwell current must be flowing but not be in limiting which preconditions two of the inputs to AND gate 134. Dwell current is caused to be ramping prior to reset of start latch 90 when the start dwell signal is high enabling AND gate 84. Hence, an instant after the start command signal is removed, $t_6$, AND gate 134 is clocked by the adaptive dwell signal to provide a reset signal to force the Q output of stall latch 90 low, at $t_7$, and the ignition system is then transitioned to its run mode without a misfire or misplaced fire occurring in the engine. Thus, charge and discharge of the adaptive dwell capacitor AC takes place as previously described and spark is generated at $t_3$ at the correct time in the firing cycle.

During normal run operation stall capacitor SC is alternately charged and discharged by current sources 122 and 132 respectively. As long as the engine rpm is fast enough to cause the stall capacitor to be charged by current source 122 during the first 25% of each firing cycle to a level to maintain a zero output at the output of comparator 114, a logic one is maintained at the output of inverter 116 which allows enabling of logic gate circuit 82. However, when the engine rpm decreases below a predetermined speed the stall capacitor is discharged below the potential $V_S$ by current source 132 whereby the logic gate circuit 84 is inhibited by a logic zero being supplied thereto from inverter 116. While the ignition system is in this stall mode no dwell current is produced and the engine can not be operated. The engine is restarted by a start command signal allowing start delay circuit to charge the stall capacitor after an initial delay as previously described.

Figure 3:
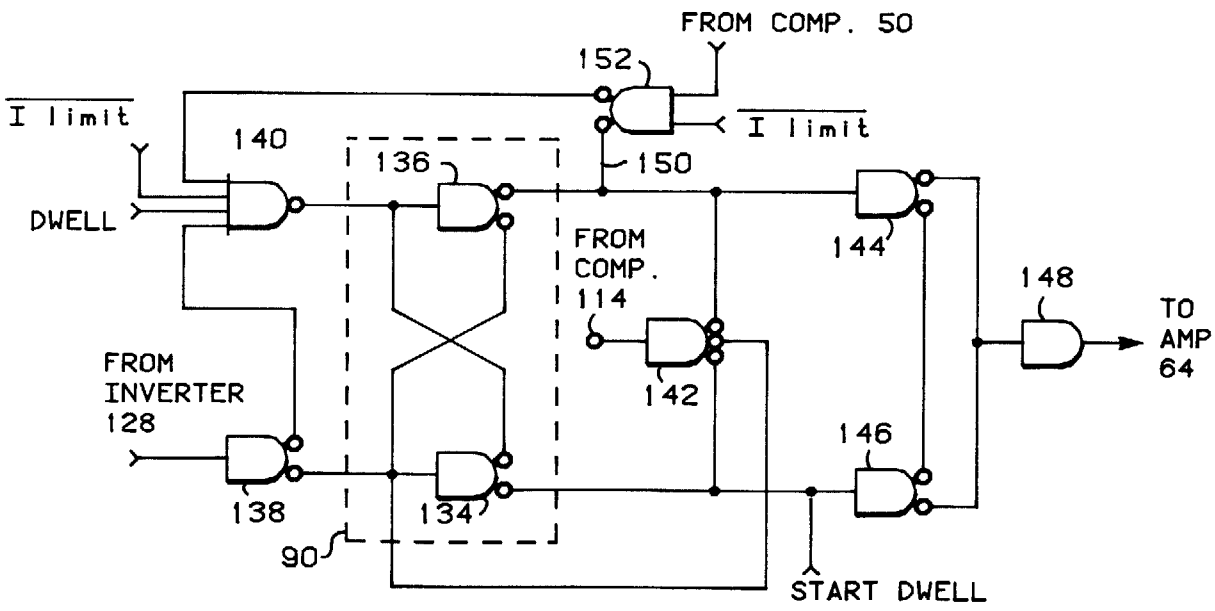
FIG. 3 is a schematic illustrating a logic circuit of the preferred embodiment.

Turning to FIG. 3 there is shown an integrated injection logic circuit which may be utilized to provide the logic functions of the start-to-run circuit described above. Thus, NAND gates 134 and 136 comprise start latch 90 with the input to gate 134 and gate 136 being the set and reset terminals respectively. Therefore, with a start command signal supplied to the ignition system the output of NAND gate 138 is low which enables gate 134 to cause its output to go high while causing, in conjunction with the high output from NAND gate 140, the output from gate 136 to be low. Assuming no stall signal the output from NAND gate 142 is high. Hence, NAND gate 144 is inhibited which puts its output in a high state while NAND gate 146 is preconditioned to be enabled by the start dwell signal. Therefore, whenever the start dwell signal goes high, gate 146 changes states to produce a logic zero to the input of AND gate 148. The output of AND gate 148 being caused to go high renders amplifier 64 conductive as previously described.

Transition to the run mode occurs when the input to NAND gate 138 goes low, removal of the start command signal, to put a logic one on one input of NAND gate 140. Whenever the remaining inputs of NAND gate 140 all go to a logic one start latch 90 is reset such that NAND gate 146 is inhibited and NAND gate 144 enabled by the adaptive dwell signal supplied thereto via lead 150 from the output of NAND gate 152 to render amplifier 64 conductive. Therefore, in response to the voltage across capacitor $C_C$ exceeding the magnitude of the threshold signal a logic one is supplied to one input of NAND gate 152 to supply a logic one at the output thereof when the current through the ignition coil is not being limited. Thus, transition can only occur after resetting of start latch 90 with all inputs to NAND gate 140 being in a logic one state. This occurs as previously mentioned only during the interval when current is ramping through the coil.

Thus, what has been described is a novel start-to-run circuit for transitioning an ignition system from a start mode of operation to a run mode operation utilizing start retard while preventing misfire or misplaced fire spark. The circuit utilizes the adaptive dwell capacitor already present in the ignition system to produce the start retard.

I claim:

1. A start-to-run circuit suitable to be utilized in an adaptive dwell ignition system for an engine having an adative dwell capacitor which provides a dwell control signal that varies the excess dwell time in response to variations in engine rpm, an amplifier which is rendered conductive in response to the dwell control signal during each firing cycle period to provide dwell current to charge an ignition coil and a feedback circuit for limiting the dwell current to a predetermined magnitude prior to discharge of the coil, comprising:

start dwell circuit means coupled with the adaptive dwell capacitor which is responsive to the ignition system being in a start mode of operation for charging and discharging the adaptive dwell capacitor for producing a first logic signal at an output thereof during a predetermined interval of each firing cycle period;

logic gate means coupled with both the ignition system and said output of said start dwell circuit means which is responsive to said first logic signal for providing first and second output signals, said first output signal rendering the amplifier conductive and said second output signal being produced while the dwell current is not being limited by the feedback circuit; and logic circuit means coupled with the ignition system, said start dwell circuit means and said logic gate means which is responsive to a start command signal supplied thereto at an input for causing said ignition system to be in a start mode of operation, said logic circuit means being responsive to the termination of said start command signal in combination with receiving said second output signal from said logic gate means for inhibiting said start dwell circuit means and causing the ignition system to transition to a run mode of operation only during a predetermined period of the firing cycle period wherein said logic gate means is enabled by the ignition system.

2. The start-to-run circuit of claim 1 wherein said start dwell circuit means includes:

first and second controlled current source means each coupled at a first circuit node to the adaptive dwell capacitor for alternately charging and discharging the capacitor between first and second potential levels when the ignition system is in a start mode; and first comparator means responsive to said potential across the adaptive dwell capacitor being at a predetermined one of said first and second potential levels for producing said first logic signal.

3. The start-to-run circuit of claim 2 wherein said logic circuit means includes start latch means responsive to said start command signal for producing both a second logic signal to said first and second controlled current sources and said logic gate means and a third logic signal which is the complementary of said second logic signal to said logic gate means and the ignition system, said start latch means being responsive to said second output signal from said logic gate means concurrent with termination of said start command for causing said second and third logic signals to be switched to their complementary logic state.

4. The start-to-run circuit of claim 3 wherein said logic gate means includes:

a first logic gate having inputs coupled to said start latch means and said comparator means and an output;

a second logic gate having inputs coupled to said start latch means and the ignition system and an output;

transmission gate means coupled to said outputs of said first and second logic gates and having an output coupled to the amplifier; and a third logic gate having inputs coupled to said output of said transmission gate means, the ignition system and the feedback circuit and having an output at which is provided said second outputs signal.

5. The start-to-run circuit of claim 4 wherein said logic gate means further includes a second transmission gate having first and second inputs coupled respectively to said input of said logic circuit means and an output of the feedback circuit and an output coupled to an input of said third logic gate.

6. The start-to-run circuit of claim 5 wherein:

said first controlled current source includes a fourth logic gate having first and second inputs coupled respectively to said start latch circuit means and to the ignition system at which are supplied said second logic signal and an input signal and an output for rendering said first controlled current source conductive when said second logic signal and said input signal are both in a first logic state; and said second controlled current source includes a fifth logic gate having first and second inputs coupled respectively to said start latch circuit means and to the ignition system at which are supplied said second logic signal and the complementary of said input signal and an output for rendering said second controlled current source conductive when said second logic signal and said complementary signal are both in said first logic state such that said first and second controlled current sources are alternately rendered conductive and then non-conductive.

7. In an adaptive dwell ignition system including an adaptive dwell capacitor which sets the excess dwell time in a firing cycle of the ignition system, a start-to-run transitioning circuit wherein the improvement comprises the start-to-run transitioning circuit being coupled to the adaptive dwell capacitor which is responsive to the system being in a start mode only for causing the charge and discharge of the adaptive dwell capacitor to provide start retard, the start-to-run transitioning circuit being responsive to the termination of the start mode for providing transitioning of the ignition system to a run mode only during a predetermined portion of the firing cycle.

* * * * *